United States Patent [19]

Elser

[11] 4,215,795

[45] Aug. 5, 1980

[54] END STRUCTURE FOR A CAN BODY AND METHOD OF MAKING SAME

[75] Inventor: William F. Elser, Toledo, Ohio

[73] Assignee: Owens-Illinois, Inc., Toledo, Ohio

[21] Appl. No.: 8,846

[22] Filed: Feb. 2, 1979

Related U.S. Application Data

[63] Continuation-in-part of Ser. No. 836,461, Sep. 26, 1977, abandoned.

[51] Int. Cl.[2] ..... B21D 51/44; B65D 41/42

[52] U.S. Cl. ..... 220/276; 113/15 A; 113/121 C; 220/67; 220/277

[58] Field of Search ..... 113/1 F, 15 A, 121 C; 220/67, 276, 277, 273, 268, 66

[56] References Cited

U.S. PATENT DOCUMENTS

| | | | |
|---|---|---|---|
| 1,077,742 | 11/1913 | Nichols | 220/276 |
| 2,071,030 | 2/1937 | Fay | 220/277 |
| 2,119,533 | 6/1938 | Fink | 220/276 |
| 3,073,480 | 1/1963 | Henchert | 220/67 |
| 3,292,826 | 12/1966 | Abplanalp | 222/397 |
| 3,362,569 | 1/1968 | Geiger | 220/268 |
| 3,397,809 | 8/1968 | Ellerbrock | 220/277 |
| 3,929,251 | 12/1975 | Urmston | 220/268 |
| 4,027,612 | 6/1977 | Herst | 113/1 F X |

FOREIGN PATENT DOCUMENTS

| | | | |
|---|---|---|---|
| 2310170 | 12/1976 | France | 113/1 F |

*Primary Examiner*—Allan N. Shoap

*Attorney, Agent, or Firm*—John R. Nelson; Myron E. Click; David H. Wilson

[57] ABSTRACT

An end closure for a composite can body wherein the closure has a circumferential weakening line formed therein to facilitate the removal of the central portion of the closure by a can opener wherein the weakening line is formed by an offset shearing operation.

2 Claims, 5 Drawing Figures

END STRUCTURE FOR A CAN BODY AND METHOD OF MAKING SAME

CROSS REFERENCE TO RELATED APPLICATION

This application constitutes a continuation-in-part of my pending application, Ser. No. 836,461, filed Sept. 26, 1977, now abandoned.

BACKGROUND OF THE INVENTION

With the advent of fiber-bodied composite cans adopted as a low-cost container for certain products such as flavored drink concentrates and other products where the container is normally opened with a conventional can opener, it has been a constant problem for the fiber can industry to develop a can which would permit easy opening with the various types of can openers presently in use. The paperboard material usually used in fiber-bodied composite cans is softer, more compressible and thicker than the sheet metal material used in metal bodied cans. These different properties combine with the metal end conventionally used on fiber bodied cans to produce a crimp or seam which is somewhat wider and more compressible than the seam of metal bodied cans. Conventional can openers were originally designed for use with metal bodied cans which inherently have a narrower stronger bead and also a hard metal wall to produce a positive supporting surface which prevents penetration into the body wall by the toothed driving wheel in properly oriented driving relationship with the underside of the can bead, thus preventing undercutting and slippage of the driving wheel with respect to the bead. With the softer fiber body of composite cans, the driving wheel engages both the bead and adjacent outer body wall, and on certain can openers tends to penetrate into the body wall causing the driving wheel to undercut the bottom edge of the bead.

In the United States a great number of inexpensive can openers are sold each year. Many of these can openers are not sufficiently well made to work properly, even when new. Typically, they do not stand up under the heavy usage given by the modern day housewife in this country. Even if these can openers don't work properly on metal bodied cans, the housewife continues to use them; and when used on fiber bodied cans which provide less support than the metal bodied cans, slippage problems occur sufficiently often to be objectionable. Composite can opening problems have also occurred to a minor degree with certain types of more expensive can openers due to the specific construction and arrangement of the driving and cutting parts of such openers so that the opening of a composite can with the can openers presently in use has been a problem for fiber can openers.

Obviously, the problems encountered in opening the metal end closures of composite can construction are quite different from the problems encountered in opening cans having metal side wall construction. However, in both instances, when employing the conventional can opener devices to open the cans, it will be apparent that the driving force produced by the driving wheel against the can body and the underside of the bead must always be greater than the resistance of the can opener to travel around the can during the cutting operation. Thus, if this resistance can be reduced, less driving force will be required, and the possibility of the toothed driving wheel slipping on the body and underside of the bead and, thus, losing its drive, will be substantially reduced.

A number of factors influence the resistance to travel of the can opener around the top of the can. One of these factors is the resistance to cutting or breaking through of the metal itself. Another, is the frictional resistance exerted by surfaces of the bead on the elements of the can opener respectively engaged therewith. This materially increases the drag and resistance to movement of the can opener around the can which, in turn, causes slippage of the driving wheel, since the total resistance to travel becomes greater than the driving force produced by the driving wheel of the can opener. If the total resistance to travel (the resistance to cutting or breaking through the metal plus the drag resistance exerted by the can opener elements riding on the engaged surface of the bead) is less than the driving force produced by the driving wheel, the can will be easily opened by the can opener.

The concept of employing a weakening line on an end structure for a container to facilitate the opening thereof, is not basically new. The U.S. patents to J. A. Geiger, Nos. 3,362,569, 3,362,570; J. Henchert No. 3,073,480; Ellerbrock No. 3,397,809; and No. 3,929,251, Urmstrum, relate to container structures having a weakening or score line formed in the end closures to facilitate the opening thereof either with the use of conventional can opener, or by some other built-in easy-opening feature.

However, as the use of the composite can becomes more and more of an accepted manner of packaging, the manufacturing costs become more and more of a consideration. Furthermore, as production requirements increase, so does the utilization of energy. Accordingly, in addition to the mechanical and physical features of the can construction, it is an extremely important aspect of any such container, or container component, to be as inexpensive as possible so as to justify mass production.

In a number of prior art endeavors to form weakening lines in the metal end closures, extrusion or coining steps have been utilized. It will be appreciated that such a displacement of metal, particularly where dealing with steel sheet, by extrusion, requires extensive amounts of pressure by the forming presses. It has been found that a shearing or blanking operation to form the weakening line requires considerably less pressure and, thereby, reduces the cost of manufacture of the resultant end closure.

SUMMARY OF THE INVENTION

It is an object of the present invention to produce a metallic end closure for a container having an easily fractureable line formed therein to facilitate the removal of a portion of the end closure to provide access to the interior of the container.

Another object of the invention is to produce a metallic end closure for a container having a line of weakening formed circumferentially thereof which is inexpensive to manufacture.

Another object of the invention is to produce an end closure for a container having a circumferentially formed weakening line which can be formed in a single stamping operation.

Still another object of the invention is to produce a composite can structure having a laminated hollow body with at least one layer of fibrous material and end closures on the ends of the body, at least one of the end closures provided with a circumferential weakening line lying inwardly of the connecting radius between the central portion of the end closure and the circumferential upstanding under wall of the associated seam.

In accordance with the above objects and, as a feature of the invention, there is provided a one piece metallic end closure for a container with a predetermined removable end wall portion defined by a weakening line in the closure wall produced by partially shearing the wall in a die assembly and displacing it away from the interior of the container.

The above, as well as other objects of the invention, may be typically achieved by a composite can comprising a hollow body including a side wall formed of a composite fibrous material and a pair of end closures for closing the ends of the body, one of the end closures constituting a metal end seamed onto one end of the body and designed to facilitate opening thereof with a can opener of the type having a cutter element and a toothed driving wheel, wherein the improvement comprises the one of the end closures having a circumferential weakening line formed therein and lying inwardly of the connecting radius between the central closure panel of the closure end and the circumferential upstanding inner wall of the seam, the weakening line formed by an offset shearing operation causing the metal adjacent the inner side of the line to be offset substantially perpendicularly relative to the metal adjacent the outside of the line to facilitate the fracturing of the metal of the weakening line by a can opener.

BRIEF DESCRIPTION OF THE DRAWINGS

The above, as well as other objects and advantages of the invention will become apparent to one skilled in the art, from the following detailed description of a preferred embodiment of this invention when considered in the light of the accompanying drawings, in which.

DETAILED DESCRIPTION OF THE PREFERRED EMBODIMENT

Figure 1:
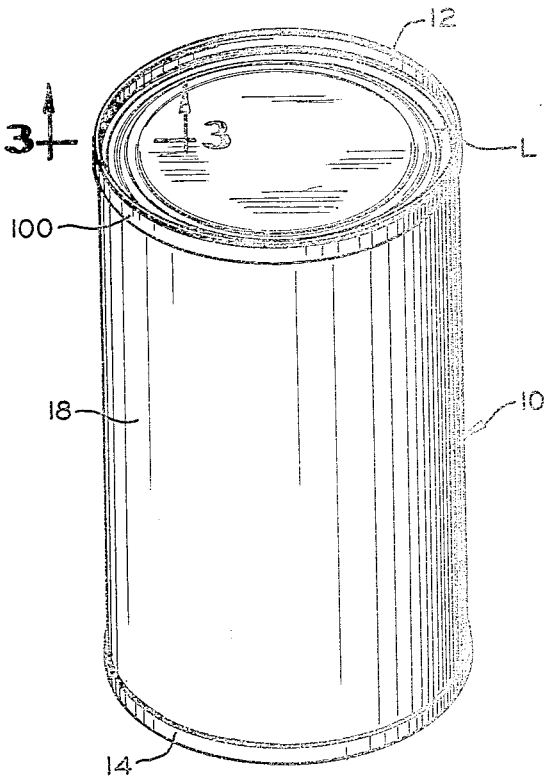
FIG. 1 is a perspective view of a composite can containing an end closure made in accordance with the present invention.

Referring to FIG. 1, there is illustrated a composite can having a helically wound side wall 10 with a pair of metallic end closures 12 and 14. Typically, the side wall 10 is formed of a helically wound laminated material 16 such as a fiber composite containing paper stock, for example, having an outer layer or label 18 adhesively secured to the outermost surface of the material 16. Obviously, the side wall 10 could be formed of a variety of different materials. It will be understood, however, that this invention is concerned with the utilization of materials for the side wall 10 which are softer and less rigid than the metal stock of the end closures 12 and 14.

The end closures 12 and 14 are secured to respective end portions of the side wall 10 by suitably accepted means such as, for example, a double seam. The double seams are formed placing the formed blank of the end closures 12 and 14 in juxtaposition to the respective end portion of the side wall 10 and exposing the combination to suitable metal forming rolls which progressively form the desired seal. The blank used for the top closure 12 is illustrated in FIG. 2 and consists of a disc shaped metal blank 20 typically formed of tin plated sheet steel of a thickness of approximately 0.0083 inches.

Figure 2:
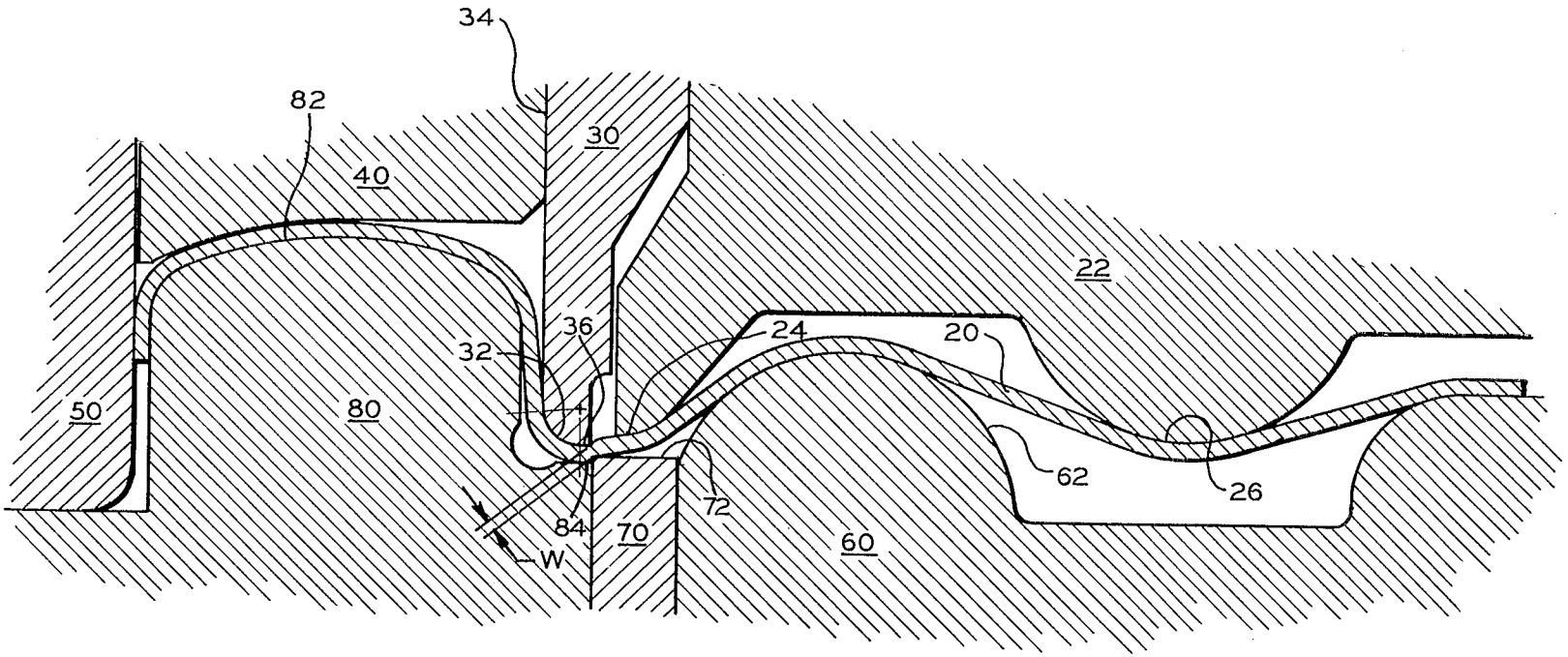
FIG. 2 is an enlarged fragmentary sectional view of an end closure of the type illustrated in FIG. 1 during the manufacturing or forming operation thereof.

The metallic blank 20, as illustrated in FIG. 2, is formed by a die assembly which includes an upper punch and a cooperating lower die. The upper punch basically includes an inner punch core 22 having a circumferential depending portion 24 formed with an inwardly struck radius and annular bead 26.

Outwardly of the inner punch core 22, there is an annular punch core 30 having an annular depending portion 32 formed with an outwardly struck radius which joins a vertically extending annular side wall 34 of the punch 30 on one side and an annular flat ring portion 36 on the other side thereof.

Surrounding the punch core 30 is a knock-out ring 40 which cooperates in the formation of the metal blank 20 and is also vertically movable with respect the other elements of the punch die and can function to assure that the blank 20 can be readily removed from the die assembly after the forming operation.

The metallic blank 20, as illustrated in FIG. 2, is formed by a die assembly which includes an upper punch and a cooperating lower die core. The upper punch basically includes an inner punch core 22 having a circumferential depending portion 24 formed with an inwardly struck radius and inwardly spaced downwardly extending annular bead 26.

Outwardly of the knock-out ring 40 is a punch ring 50.

While it will be understood that the punch die includes other elements, the elements thereof mentioned above are sufficient for the purposes of this description to explain the function of the die and the manner in which it cooperates with die core to form the blank 20 into the one end closure for a composite container structure.

The lower die includes a centrally disposed die core pad 60 having an upstanding annular bead 62 at the circumferential outer edge thereof.

Immediately adjacent and in surrounding relation to the die core pad 60 is an upwardly extending annular portion of a die core 70. The uppermost portion of the die core 70 is provided with a flat horizontally extending section 72, the opposing edges of which are defined by spaced apart vertically extending annular side walls. The outer side wall of the annular die core 70 is in general alignment with the vertically extending wall portion 35 of the punch core 30, the lower edge of which joins the inner edge of the flat ring portion 36. As a general rule, satisfactory results are achieved when the cutting edges of the punch core 30 and die core 70 lie in substantially the same vertically extending plane, the axis of which is normal to the horizontal plane of the die assembly.

An annular die core ring 80 is disposed in surrounding relation to the die core 70 and is provided with an upstanding annular bead 82 which is formed on the outermost portion of upper circumferential surface thereof. On the innermost portion of the upper circumferential surface of the die core ring 80 is a flat annular ring surface 84.

FIG. 2 shows the die assembly in a position after the upper panel and the cooperating lower die core have been pressed together to form the metal blank 20 into the desired configuration to be sealed to the upper end of the container body 10. An important aspect of the forming operation effected by the die assembly is the formation of a weakening line L which is accomplished by a partial shearing or cutting operation. This partial shearing of the metal of the blank 20 to form the weakening line L is brought about by the coaction between the inner cutting edge of the flat ring section 36 of the punch core 30 and the outer cutting edge of the flat surface 72 of the die core 70. During the downward motion of the punch into the cooperating die core, the metal between the respective cutting edges of the punch core 30 and the die core 70 is partially sheared which effectively reduces the thickness of the metal of the blank 20 along the annular line L to a thickness indicated by W which is less than the original thickness of the blank. The offset shearing operation employed to form the weakening line L involves partially cutting the metal blank 20 by the cutting edges of the cooperating die components 30 and 70 wherein the metal blank is initially stressed in shear between the annular cutting edges to a point just prior to a complete fracture of the metal or just prior to the ultimate strength of the metal is surpassed. The metal is subjected to both tensile and compressive stresses; stretching beyond the elastic limit of the metal occurs; then plastic deformation; reduction in area; and, finally, fracturing of the metal commences in a substantially vertical annular cleavage plane in the previously formed weakening line L. The process is halted prior to complete fracturing of the metal in the cleavage plane. The shearing forces applied by the cutting edges of the die components 30 and 70 causes the inner edge of the annular flat section 108 and the outer edge of the closure 12 of the end closure being formed to slide relatively to each other in a direction parallel to their plane of contact.

Figure 5:
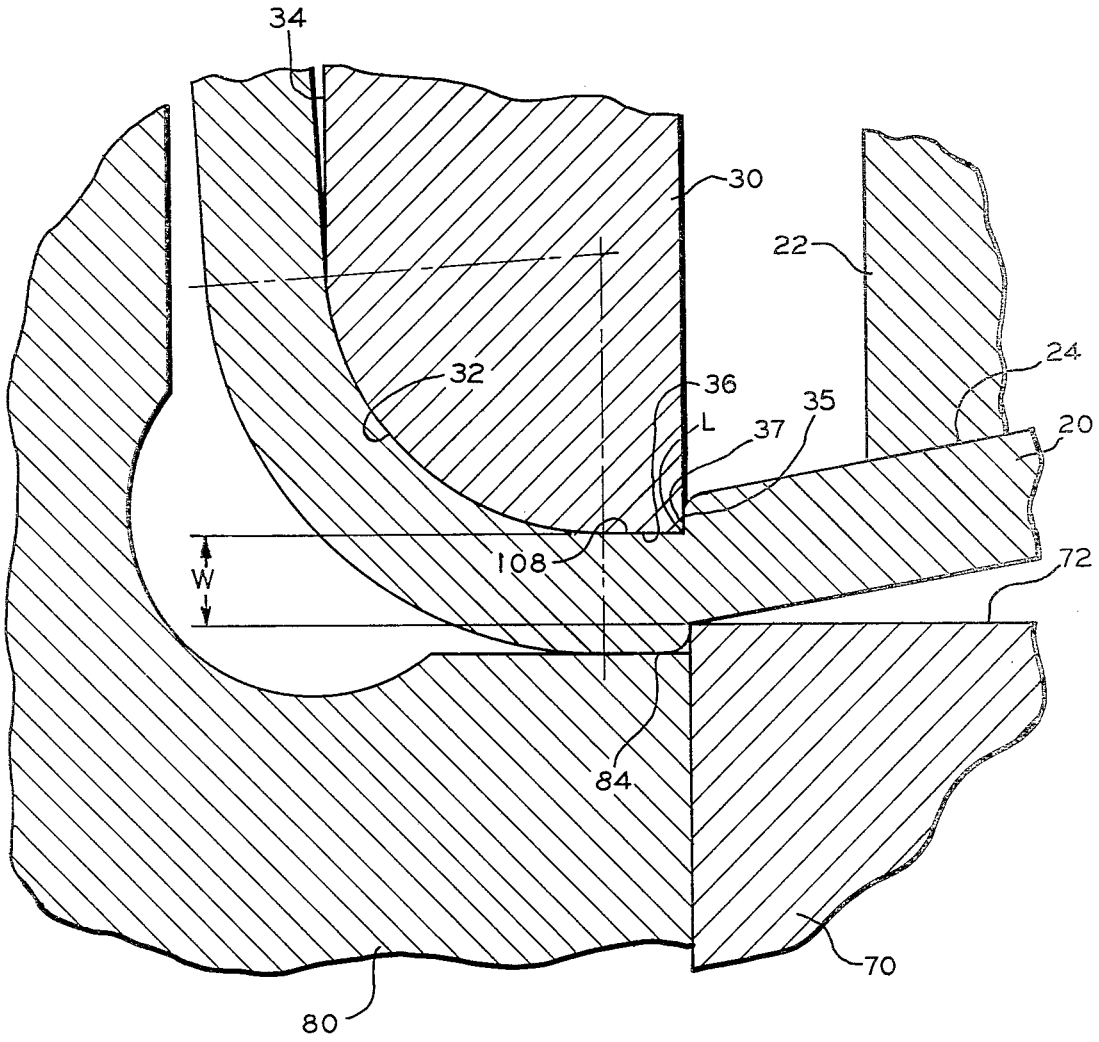
FIG. 5 is an enlarged fragmentary view of a portion of the section illustrated in FIG. 2.

The described shearing operation is deemed beneficial in reducing the power requirements which would otherwise be necessary to achieve a weakening line by the prior art extrusion methods. An important feature of the die configuration resides in the specific shape and resultant function of the annular flat section 36 of the punch core 30 and the cooperating flat section 84 of the die core ring 80. It will be appreciated that in the event the curved lower surface 32 did not terminate in a flat section 36, the shearing pressure imposed on the metal being worked at this zone would be very high and while the offset shearing operation could be achieved the finished product would be left with a slight extension in the metal resulting in an additional weakening line formed in the metal adjacent the desired weakening line L. Manifestly, this would produce a weakening line of different resistance to the opening of the can end. This undesirable feature is prevented by shaping the cooperating dies to form a flat section 108 in the finished product as clearly apparent in FIG. 5.

Figure 3:
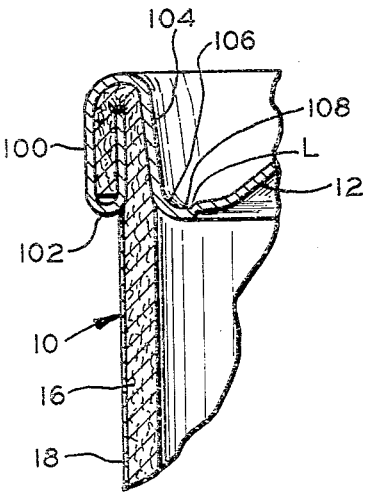
FIG. 3 is a sectional view of the end closure of FIG. 2 after it has been sealed to the container body of FIG. 1 taken along line 3—3 thereof.

After the metal blank 20 is formed by the die assembly as illustrated in FIG. 2, and the contents are placed within the interior of the container body 10, the end closure 12 is sealed to the end thereof. The typical type of seal structure is illustrated in FIG. 3 wherein there is shown a double seam construction comprising an outer bead portion 100 having a lower bead portion 102, and an inner peripheral rim or chuckwall 104. The central panel of the end closure 12 is connected to the rim or chuckwall 104 by a section 106 formed on a radius and a flat section 108 positioned inwardly of the section 106 and adjacent the weakening line L.

Figure 4:
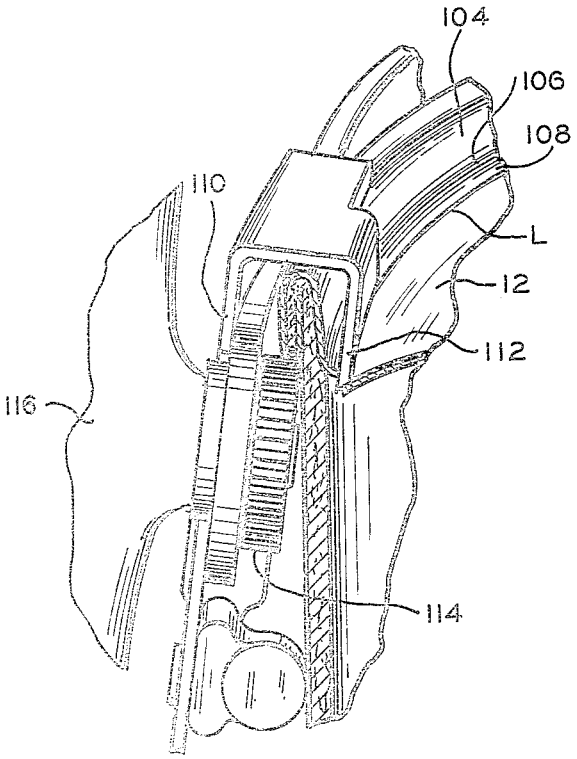
FIG. 4 is an enlarged fragmentary perspective view of the composite can end with a can opener shown in cutting position.

The end closure 12 with the weakening line L is opened by a conventional household can opener which is a scissor or plier type as illustrated in FIG. 4. These openers are provided with a pair of pivotally interconnected cooperating lever arms one which carries a mounting plate 110 having a downwardly extending cutting member 112. A toothed driving wheel 114 is pivotally mounted to the end portion of the other lever arm which is driven by a suitable driving handle 116. In operation, the associated lever arms are squeezed together to cause the sharp portion of the cutting member 112 to move into a cutting position against the flat section 108 immediately adjacent the weakening line L. It must be understood that the bead 100 must have sufficient strength to resist collapsing under the pressure produced by the cutting member 112 and the driving wheel 114. After the initial piercing operation, the turning of the handle 116 to drive the toothed driving wheel 114 and thereby cause the cutting member 112 to travel around the inside of the rim 104 constantly being guided by the upstanding vertical edge 37 of the weakening line L to effectively cut out the central portion of the end closure 12 defined by the weakening line. The driving force produced by the driving wheel 114 in engagement with the lower edge 102 of the bead 100 must be greater than the resistance produced by the cutting member 112 cutting through the metal end closure 12 and the frictional resistance to travel of the can opener around the circumference of the can. By providing the offset sheared formed weakening line L, the resistance to cutting is substantially reduced and, thus, the driving force produced by the driving wheel 114 is maintained at a higher level than the drag produced by the opening operation.

Since the contents of the composite container or can of this invention are typically maintained in vacuum, the pressure outside of the can being greater than the pressure within the can. Thus, the central portion of the end closure is constantly urged inwardly against the material thereof adjacent the radius formed section 106 and the flat portion 108. Due to the particular structure of the weakening line L, there is a greater resistance to fracturing with the pressures acting as above described. More specifically, the forces tending to fracture the metal at the weakening line L which act downwardly and inwardly of the central portion of the end closure 12 must shear the opposing columns of metal, each column being equal to the panel thickness of the metal of the end closure 12. On the other hand, with the forces working in opposite directions, only a small remnant of metal must be fractured to open the can end. Therefore, the innermost surface of the cutting member 112 of the can opener, as it is being guided in its circumferential travel by the upper vertically extending annular upstanding vertical metal edge 37 formed at the weakening line L, has to only cut through or fracture the remnant metal of a thickness W rather than the full thickness of the metal blank 20.

The synergistic effect of forming the weakening line L by the offset shearing operation not only reduces the energy requirements necessary to form the weakening line L from other known techniques, but also provides a structure which resists fracturing by the forces thereon caused by maintaining the interior of the container in vacuum, for example, and simultaneously facilitates the fracturing thereof for opening purposes, and produces a vertically extending annular surface to assist in guiding the cutting member 112 of a can opener during the operation thereof.

In accordance with the provisions of the patent statutes, I have explained the principle and mode of operation of my invention and have illustrated and described what I now consider to represent its best embodiment. However, I desire to have it understood that within the scope of the appended claims, the invention may be practiced otherwise than as specifically illustrated and described.

I claim:

1. A container closure with a central panel having a selectively weakened fracturable path means for facilitating removal of a central panel in response to a force exerted against such fracturable path means, said closure comprising:

an annular outer rim;

an annular flat section extending inwardly from said annular rim and joined thereto by an intermediate radius portion;

a central panel; and a weakened path of reduced thickness joining said flat section and said central panel wherein the circumferential edge portion of said central panel defines an upwardly extending, outwardly laterally facing marginal edge and the inner portion of said annular flat section defines a downwardly extending, inwardly laterally facing marginal edge, the edges being substantially normal to the plane of the closure and being axially aligned.

2. A method of forming an end closure for a composite can comprising the steps of:

providing a blank of sheet material;

forming said blank in a single die operation including contouring said blank and producing a circumferential central panel surrounded by a circumferential rim and an annular weakening line separating said central panel and said rim, said annular weakening line being formed in said blank by causing exterior and interior surfaces of said blank to be offset in a direction normal to the plane of said closure to simultaneously form an upwardly extending, outwardly laterally facing annular marginal edge about the periphery of said central panel of said exterior surface and a downwardly extending, inwardly laterally facing annular marginal edge about said interior surface, the edges being axially aligned.

* * * * *